US009840879B2

(12) United States Patent
Logan et al.

(10) Patent No.: US 9,840,879 B2
(45) Date of Patent: Dec. 12, 2017

(54) ROTARY LOCKING SUB FOR ANGULAR ALIGNMENT OF DOWNHOLE SENSORS WITH HIGH SIDE IN DIRECTIONAL DRILLING

(71) Applicant: EVOLUTION ENGINEERING INC., Calgary (CA)

(72) Inventors: Aaron W. Logan, Calgary (CA); Patrick R. Derkacz, Calgary (CA); Justin C. Logan, Calgary (CA); David A. Switzer, Calgary (CA)

(73) Assignee: Evolution Engineering Inc., Calgary (CA)

( * ) Notice: Subject to any disclaimer, the term of this patent is extended or adjusted under 35 U.S.C. 154(b) by 212 days.

(21) Appl. No.: 14/648,960

(22) PCT Filed: Dec. 17, 2013

(86) PCT No.: PCT/CA2013/050983

§ 371 (c)(1),
(2) Date: Jun. 2, 2015

(87) PCT Pub. No.: WO2014/094161

PCT Pub. Date: Jun. 26, 2014

(65) Prior Publication Data

US 2015/0300098 A1 Oct. 22, 2015

Related U.S. Application Data

(60) Provisional application No. 61/738,389, filed on Dec. 17, 2012.

(51) Int. Cl.
*E21B 17/043* (2006.01)
*E21B 47/01* (2012.01)
(Continued)

(52) U.S. Cl.
CPC ..... *E21B 17/043* (2013.01); *E21B 7/067* (2013.01); *E21B 17/00* (2013.01); *E21B 17/042* (2013.01);
(Continued)

(58) Field of Classification Search
CPC ..... E21B 17/043; E21B 7/067; E21B 17/00; E21B 17/042; E21B 17/05; E21B 47/01; E21B 47/024
(Continued)

(56) References Cited

U.S. PATENT DOCUMENTS 4,303,135 A * 12/1981 Benoit ..... E21B 7/067 175/256
4,575,359 A * 3/1986 Bermingham ..... E21B 3/02 464/123

(Continued)

*Primary Examiner* — Taras P Bemko
(74) *Attorney, Agent, or Firm* — Oyen Wiggs Green & Mutala LLP

(57) ABSTRACT

Adjustment of the angle of a bent sub or other steering feature in a drill string relative to a reference angle of a downhole sensor is facilitated by a rotatable coupling between the bent sub and the sensor. The rotatable coupling may be rotated to align the high side with a reference indicium and locked at the set angle. Rows of ceramic balls retained in circumferential channels may be provided to permit rotation while carrying tensile and compressional forces. Calibration of the sensor is facilitated and opportunities for certain measurement errors are eliminated. An embodiment provides a mechanism for locking the rotatable coupling at a desired angle. The embodiment comprises a ring with teeth that engage a downhole portion of the coupling and depressions that engage an uphole portion of the coupling.

31 Claims, 18 Drawing Sheets

(51) Int. Cl.

| | |
|---|---|
| ***E21B 47/024*** | (2006.01) |
| ***E21B 7/06*** | (2006.01) |
| ***E21B 17/05*** | (2006.01) |
| ***E21B 17/00*** | (2006.01) |
| ***E21B 17/042*** | (2006.01) |

(52) U.S. Cl.
CPC ..... *E21B 17/05* (2013.01); *E21B 47/01* (2013.01); *E21B 47/024* (2013.01)

(58) Field of Classification Search
USPC ..... 166/237
See application file for complete search history.

(56) References Cited

U.S. PATENT DOCUMENTS

| | | | | |
|---|---|---|---|---|
| 4,828,050 | A | 5/1989 | Hashimoto | |
| 5,368,110 | A | 11/1994 | French | |
| 5,368,111 | A | 11/1994 | Benoit et al. | |
| 5,419,405 | A | 5/1995 | Patton | |
| 5,458,208 | A | 10/1995 | Clarke | |
| 6,373,248 | B1 * | 4/2002 | Poitzsch ..... | G01N 24/081 324/300 |
| 6,942,044 | B2 | 9/2005 | Moore et al. | |
| 2004/0084219 | A1 | 5/2004 | Moore et al. | |
| 2007/0138720 | A1 | 6/2007 | Evans | |
| 2007/0256829 | A9 * | 11/2007 | Hosie ..... | E21B 33/0407 166/250.01 |

* cited by examiner

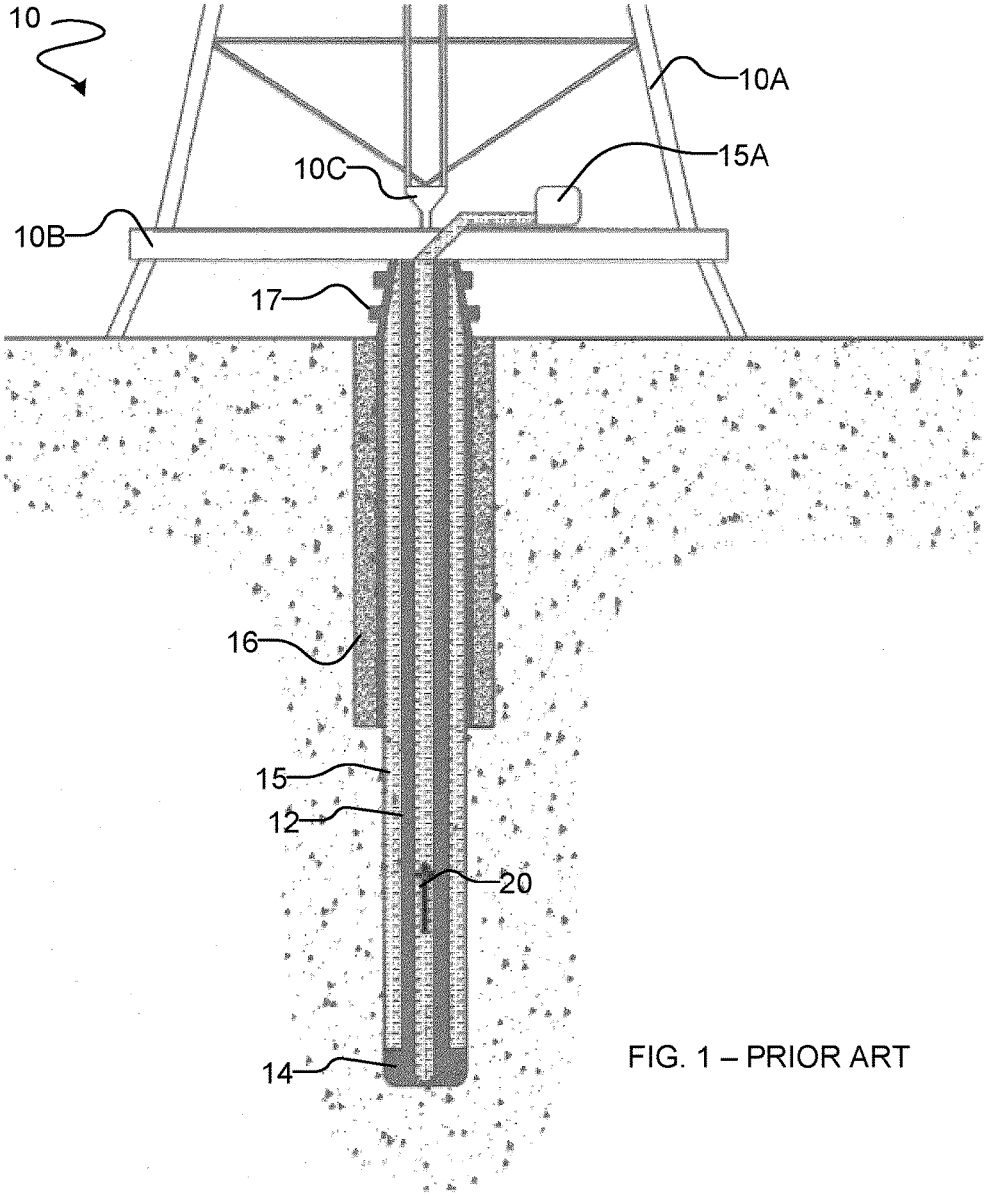
FIG. 1 – PRIOR ART

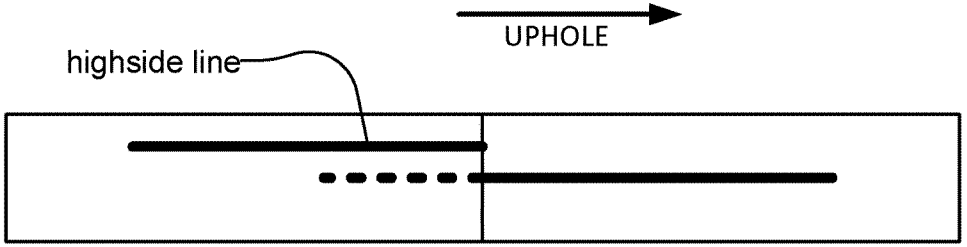
FIG. 1A – PRIOR ART
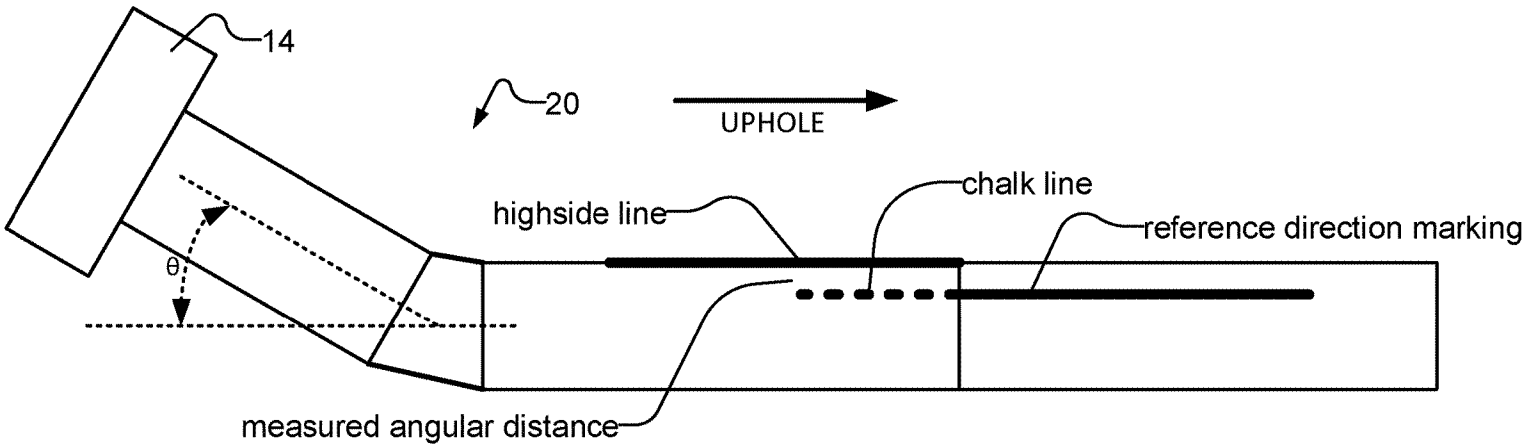
FIG. 1B – PRIOR ART

ROTARY LOCKING SUB FOR ANGULAR ALIGNMENT OF DOWNHOLE SENSORS WITH HIGH SIDE IN DIRECTIONAL DRILLING

CROSS REFERENCE TO RELATED APPLICATION

This application claims priority from U.S. application Ser. No. 61/738,389 filed 17 Dec. 2013. For purposes of the United States, this application claims the benefit under 35 U.S.C. §119 of U.S. application Ser. No. 61/738,389 filed 17 Dec. 2013 and entitled APPARATUS FOR ANGULAR ALIGNMENT OF DOWNHOLE SENSORS WITH HIGH SIDE IN DIRECTIONAL DRILLING which is hereby incorporated herein by reference for all purposes.

TECHNICAL FIELD

This application relates to subsurface drilling, specifically to directional drilling. Embodiments are applicable to drilling wells for recovering hydrocarbons. The invention relates particularly to drilling systems which use bent subs in combination with measuring while drilling (MWD) systems to steer drilling of wellbores.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Directional drilling involves guiding a drill bit in order to steer a well bore away from the vertical. Directional drilling may be used to cause a well bore to follow a desired path to a formation that is away to one side of the drill rig. Measurement while drilling (MWD) equipment is used to relay to the surface information from a probe located downhole. The information can be used by the crew of the drill rig to make decisions as to how to control and steer the well to achieve a desired goal most efficiently. The information may, for example, include inclination and azimuth of a portion of the drill string that includes a downhole probe.

In some directional drilling applications, a drill bit is turned by a mud motor in the bottom hole assembly. The mud motor is driven by high pressure drilling mud supplied from the surface. While the drill bit is being driven by the mud motor, it is not necessary to drive the drill bit by rotating the entire drill string.

Steering is typically accomplished by providing a bent sub, which is a section of the drill string which bends through a small angle as opposed to being straight. FIG. 1B shows an example bent sub 20 in which the bent sub turns through an angle θ (which is exaggerated in the Figure). The bent sub is typically located close to the drill bit. The bend in the bent sub causes the drill bit to address the formation being drilled into at an angle. This angle is primarily determined by the degree of bend of the bent sub.

The direction in which the bent sub deviates from the longitudinal axis of the drill string is called the high side. The high side identifies a direction projecting radially outwardly from the main longitudinal axis of the drill string in the direction to which the bent sub is bent. The direction in which the drill bit will progress when driven by the mud motor is determined primarily by the orientation of the drill bit. This orientation may be defined by a "tool face" which is a plane perpendicular to the axis of rotation of the drill bit. The path taken by a well bore can be steered by turning the drill string such that the direction in which the drill bit is facing is changed.

Bent subs are often magnetic, and the sensors in downhole probes may need to be a sufficient distance away from magnetic material (e.g. 60 feet) in order to function properly. Thus, downhole a probe is typically mounted in a section of drill string above a bent sub.

Drillers require high quality timely information from downhole sensors to perform efficient and accurate directional drilling. Inaccurate or out-of-calibration information can result in a wellbore following a path that is inefficient and/or problematic. Mistakes in calibrating sensors can result in expensive consequences. There remains a need for ways to provide accurate telemetry information in directional drilling.

SUMMARY

This invention has various aspects. One aspect provides a drill string section comprising a first part, a second part, and a rotary locking mechanism operable to selectively permit or prevent relative rotation of the first and second parts. The coupling comprises a ring. The ring is slidably and non-rotatably mounted on the first part. The ring comprises engagement features configured to engage corresponding engagement features on the second part. The coupling has a rotatable configuration, in which the engagement features of the ring do not engage the engagement features of the second part, and a locked configuration, in which the engagement features of the ring engage the engagement features of the second part. The coupling comprises a locking mechanism for holding the coupling in the locked configuration. In some embodiments the material of the drill string section is a non-magnetic material.

In some embodiments the first part comprises an uphole part comprising an uphole coupling for coupling to an uphole section of drill string and the second part comprises a downhole part comprising a downhole coupling for coupling to a downhole section of drill string.

In some embodiments the first part comprises a downhole part comprising a downhole coupling for coupling to a downhole section of drill string and the second part comprises an uphole part comprising an uphole coupling for coupling to an uphole section of drill string.

In some embodiments the engagement features comprise teeth on a longitudinal end of the ring.

In some embodiments the teeth are equally spaced around the circumference of the ring.

In some embodiments the coupling is lockable in at least 2 and more preferably, at least 60 distinct locked configurations each providing a distinct angular orientation between the first and second parts. In some embodiments the coupling is lockable in 72 distinct locked configurations. In another example embodiment the coupling is lockable in 180 or 360 equally angularly-spaced-apart locked configurations such that the coupling can be used to set the angular orientation between the first and second parts to within two degrees or one degree respectively. In some embodiments the number of distinct locked configurations is selected based on the required angular resolution and strength of the coupling.

In some embodiments the ring is non-rotatably mounted on the first part by a splined coupling.

In some embodiments the splined coupling comprises a depression in the ring dimensioned to receive a projection extending from the first part.

In some embodiments the splined coupling comprises a plurality of depressions in the ring extending longitudinally and spaced apart circumferentially along an interior surface of the ring.

In some embodiments a first bore extends through the first part and a second bore extends through the second part.

In some embodiments a male portion of the first part extends into a female portion of the second part, the female portion of comprising a length of the second bore.

In some embodiments the male portion and the female portion comprise corresponding grooves which define channels dimensioned to receive a plurality of holding members.

In some embodiments the female portion comprises openings for inserting the plurality of holding members into the channels.

In some embodiments male portion, female portion, channels, and holding members are dimensioned such that when male portion is inserted into female portion and holding members are inserted into the channels, first part can rotate relative to second part but cannot move longitudinally relative to second part.

In some embodiments the holding members comprise balls.

In some embodiments the drill string section comprises a locating feature in the first bore of the first part for holding a downhole probe at a fixed rotation angle in the first bore.

In some embodiments the drill string section comprises an indicium on the outside of the first part indicating a desired highside alignment.

In some embodiments the locking mechanism comprises a collar with threads that are engageable with threads on the second part to advance the collar longitudinally and thereby compress the ring between the second part and a shoulder of the collar.

In some embodiments the locking mechanism comprises a collar with threads that are engageable with threads on the first part to advance the collar longitudinally and thereby compress the ring between the second part and a shoulder of the collar.

In some embodiments the drill string section comprises a first sealing member between the collar and the first part.

In some embodiments the drill string section comprises a second sealing member between the collar and the second part.

In some embodiments the threads of the collar are located between the first and second sealing members.

In some embodiments the drill string section comprises a third sealing member between the first and second parts.

In some embodiments the first and second parts are coupled by a rotary coupling arranged to allow relative rotation of the first and second parts but to prevent axial motion of the first part relative to the second part. In some embodiments the rotary coupling comprises a first plurality of circumferential grooves on an outer surface of the first part and a second plurality of circumferential grooves on an inner surface of the second part, the grooves of the first plurality of grooves axially aligned with the grooves of the second plurality of grooves, and a plurality of balls each engaged in one of the first plurality of grooves and one of the second plurality of grooves.

Another aspect of the invention provides a drill string section comprising an uphole part and a downhole part. A bore extends through the uphole and downhole parts. The uphole part comprises an uphole coupling for coupling to an uphole part of a drill string. The downhole part comprises a downhole coupling for coupling to a downhole part of the drillstring. A rotatable and lockable coupling is arranged to couple together the uphole and downhole parts.

In some embodiments the drill string section comprises a locating feature in the bore of the uphole part for holding a downhole probe at a fixed rotation orientation in the bore; and indicia on an outside of the uphole part indicating a desired highside alignment.

In some embodiments the uphole and downhole parts are coupled together with a splined connection in which male splines on one of the uphole and downhole parts engage female splines on the other one of the uphole and downhole parts wherein the uphole and downhole parts may be separated, rotated to a desired angle corresponding to an alignment of the splines, and then coupled together in the desired rotational position.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

FIG. 1 is a schematic illustration of an example drill rig.

FIGS. 1A and 1B are schematic illustrations of a drill string which includes a bent sub for directional drilling.

In FIGS. 4B and 4C, some portions of the coupling are not illustrated in order to show otherwise hidden structures.

DESCRIPTION

Figure 2:
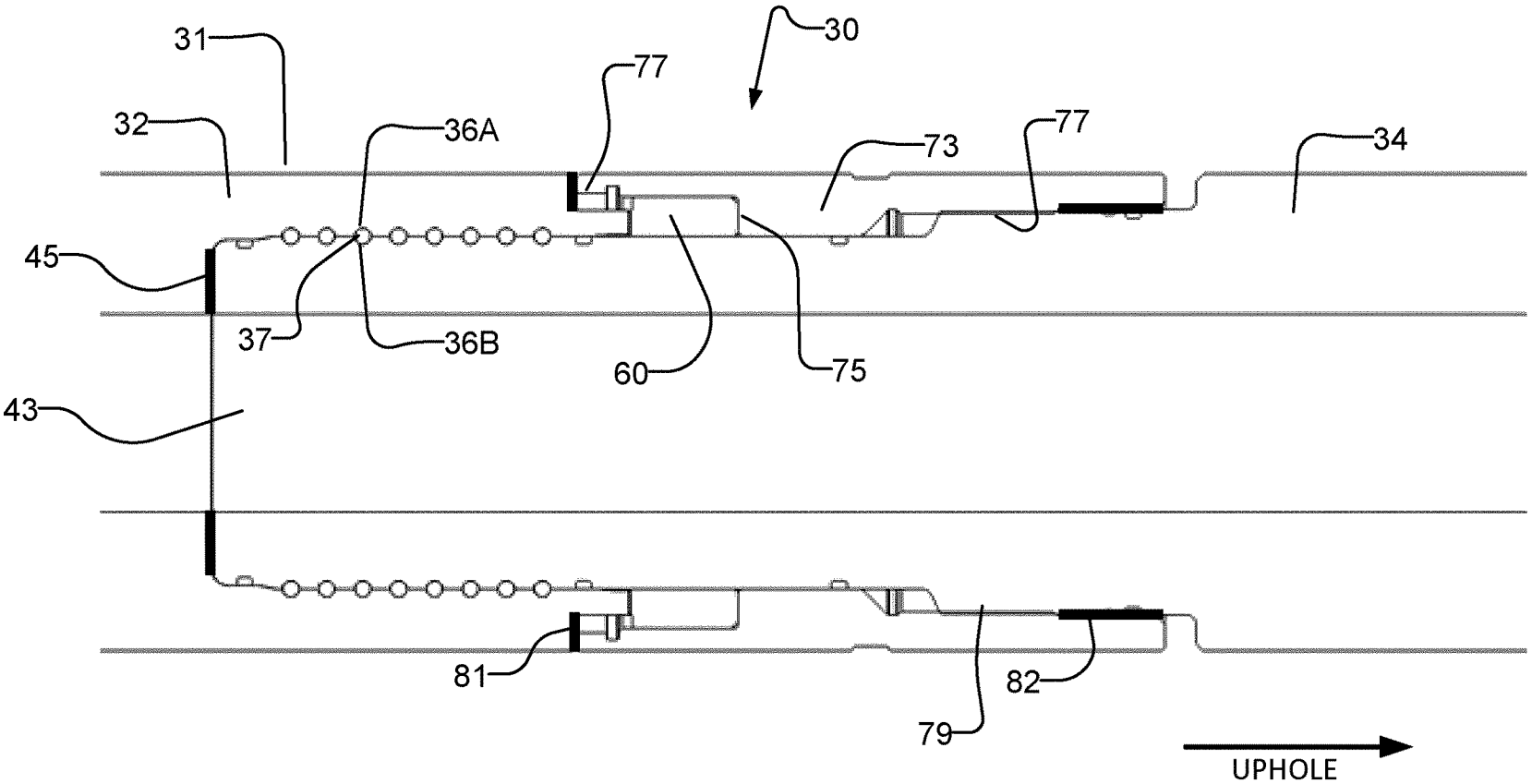
FIG. 2 is a cross-sectional view of a drill string section comprising an adjustable rotary coupling according to an example embodiment.

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B, and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

During directional drilling of a well bore, a driller typically begins by drilling a vertical section of the well bore and then causes the well bore to deviate from the vertical. This can be called "kicking off". The driller may receive measurements to assist in determining the trajectory being followed by the well bore. Measurements that may be provided from a downhole probe include inclination from vertical and azimuth (compass heading). A downhole probe typically includes various sensors that may include accelerometers, to measure inclination, as well as magnetometers, to measure azimuth. Steering the drill to cause the wellbore to follow a desired path requires information as to the relative angular position of the tool face in the bore hole (known as the "roll").

To determine the roll from inclination and azimuth sensor readings, one needs to know how the sensors are aligned relative to the bent sub. The sensors are typically located in a downhole probe which may be in a different drill string section from the bent sub. Consequently, the alignment of the sensors to the bent sub depends both on the alignment of the probe relative to the drill string section in which it is supported as well as the alignment of the drill string section holding the probe to the bent sub. Since drill string sections are typically coupled to one another by screw couplings, the relative angle between two coupled-together drill string sections can vary depending upon the torque applied to fasten the screw couplings as well as the degree to which the screw couplings may be worn. Consequently, calibration procedures must be undertaken in order to permit a driller to determine the current orientation of the bent sub from sensor readings received at the surface. These calibrations are susceptible to error.

Typically, the angular difference between a reference direction for downhole sensors and the high side direction of the bent sub is measured at the surface (see FIG. 1B). The measured angular difference is entered as a calibration factor into MWD equipment. Measuring this angle is sometimes done by suspending the bottom hole assembly vertically on the drill rig. The operator may draw a chalk line up the drill string from the high side of the bent sub up to the drill string section containing the sensor. Another mark indicating a reference direction for the sensor may have previously been made on the drill string housing the directional sensor.

(Sometimes this mark is machined into the collar to indicate the keying position of a tool inside the collar.) The operator can then measure the angular difference between these two markings and then enter the measured angle (making sure the sign is correct) into the MWD equipment. (Alternatively, the operator may draw a chalk line down the drill string from the reference direction marking, as seen in FIG. 1B.)

Errors in measuring the angular relationship between the sensors in the probe and the drill string section housing the probe, errors in measuring the angle of the bent sub relative to the drill string section housing the probe, and errors in entering the resulting angle into MWD equipment can all lead to inaccuracies. In extreme cases, these inaccuracies can result in the well bore following a completely unintended path.

Embodiments of this invention provide a rotatable and lockable coupling in the drill string. The coupling may be provided between a bent sub or other steering component in a drill string and a probe. The coupling can be released to permit the bent sub to be swiveled relative to the probe. This construction permits the high side of the bent sub to be rotated relative to the probe to achieve a desired alignment between the high side of the bent sub and the probe. For example, the relative angle between the bent sub and a reference direction for the probe may be set to zero (such that no calibration factor is required).

The rotatable coupling must be suited to downhole conditions. One issue is that the drill string is subject to extreme torques. Consequently, the rotatable coupling and its rotary locking mechanism must be sufficiently robust to withstand such torques while preventing relative rotation of the bent sub and the probe when the rotatable coupling is locked. In some embodiments, the components of the rotary locking mechanism have cross sections sufficient to withstand torques in excess of 30,000 foot-pounds without damage.

The rotatable coupling may have any of a large number of alternative constructions. One example construction which provides various advantageous features is illustrated in FIG. 2.

FIG. 2 shows an example rotatable coupling 30. Coupling 30 may be incorporated into a drill string section 31. The drill string section may, for example, have standard couplings 31A and 31B on its uphole and downhole ends (see FIG. 4A) for respective connection to an uphole part of the drill string and a downhole part of the drill string. The standard couplings may comprise, for example, API threaded couplings as specified, for example, in API specification 7.

The drill string section 31 in which coupling 30 is located may be a stand alone section or may incorporate one or both of the probe and the bent sub. When coupling 30 is incorporated into the drill string, the probe may be uphole from coupling 30 and the bent sub may be downhole from coupling 30.

Rotatable coupling 30 permits relative rotation between a female tubular part 32 and a male tubular part 34. Female part 32 is downhole relative to male part 34. However, other embodiments may have the reverse configuration. Parts 32 and 34 are coupled together in a manner which permits them to rotate relative to one another and also to transmit compressional and tensile forces.

In the illustrated embodiment, parts 32 and 34 have a series of matching circumferential grooves 36A and 36B that are longitudinally spaced apart. Grooves 36A are provided in an inside diameter of female part 32, and grooves 36B are provided on an outside diameter of male part 34. Each pair of grooves 36A and 36B defines between them a circumferential channel which can receive holding members.

In the illustrated embodiment, the holding members comprise spherical balls 37. Balls 37 may, for example, be ceramic balls. Balls 37 can transmit longitudinally directed forces between parts 32 and 34 in either direction while still permitting rotation of parts 32 and 34 relative to one another about the longitudinal axis of rotatable coupling 30. Holes 41 are provided for insertion of balls 37 into the channels defined by grooves 36A and 36B. Holes 41 may be subsequently plugged to prevent balls 37 from escaping and to prevent the inflow of drilling fluid.

A bore 43 extends through rotational coupling 30. Drilling fluid may be pumped through bore 43. A sealing member 45 prevents leakage of drilling fluids from bore 43 at the interface between parts 32 and 34. Sealing member 45 may, for example, comprise suitable O-rings.

Rotatable coupling 30 may remain concentric with a longitudinal centerline, which may be a centerline of bore 43 as well as an axis of couplings 31A and 31B for all angles of rotation.

Figure 3:
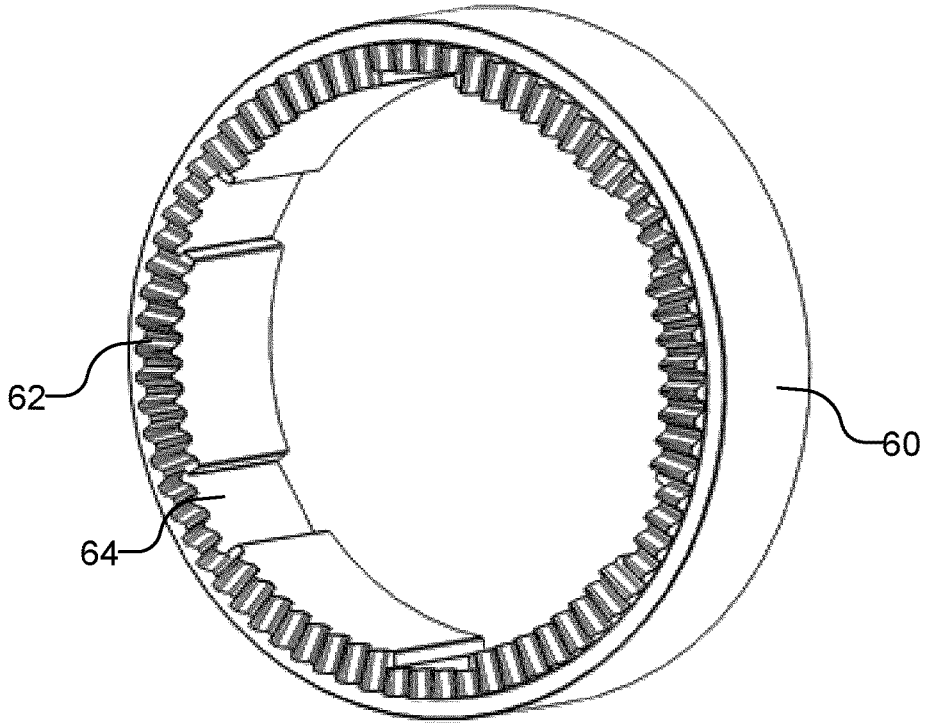
FIG. 3 is an isometric view of a ring part of the coupling of FIG. 2.
Figure 3A:
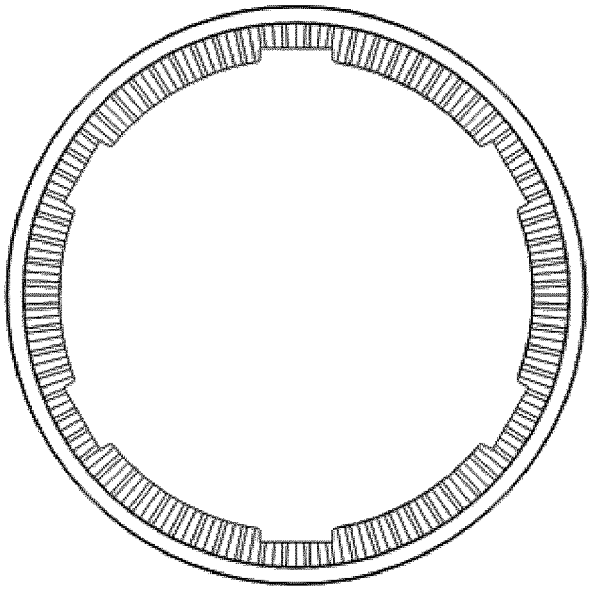
FIG. 3A is a plan view of the ring part.
Figure 3B:
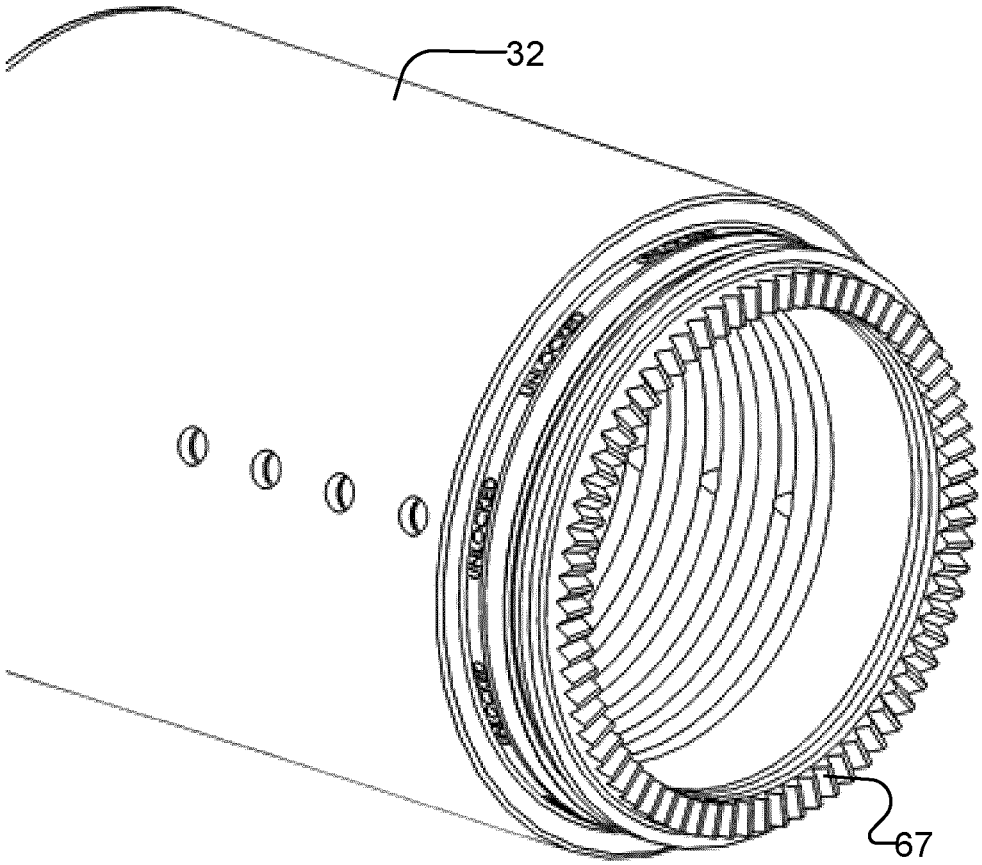
FIGS. 3B and 3C show respectively first and second parts of a drill string section generally like that shown in FIG. 2 that may be rotated with respect to one another or locked in a desired relative rotation by a rotational locking mechanism as described herein.
Figure 3C:
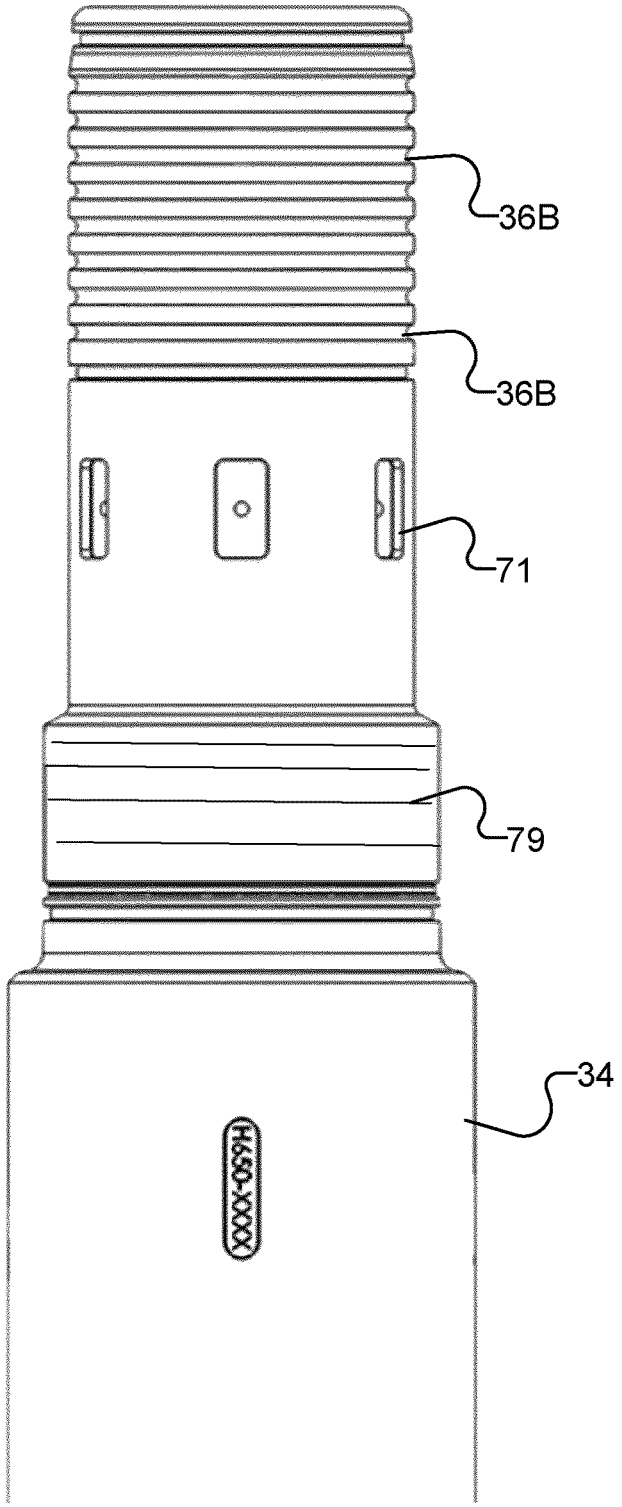

A locking mechanism is provided to permit coupling 30 to be locked with parts 32 and 34 at a desired relative angle of rotation. In the illustrated embodiment the locking mechanism comprises a ring 60 (see FIG. 3). Ring 60 is slidably but non-rotatably mounted to male part 34. Ring 60 has features that can engage corresponding features on female part 32 when ring 60 is slid toward female part 32. Ring 60 may be slid away from female part 32 to disengage the features of ring 60 from the features of female part 32 to permit relative rotation of parts 32 and 34.

In the illustrated embodiment, ring 60 comprises a series of teeth 62 projecting from one of its longitudinal ends. A series of teeth 67 project from a longitudinal end of female part 32. Teeth 62 and teeth 67 are dimensioned to interface to prevent relative rotation of female part 32 and ring 60 when they are engaged with one another. In some embodiments female part 32 and ring 60 have the same number of teeth. In some embodiments, one of female part 32 and ring 60 has a full set of teeth, and the other of female part 32 and ring 60 has fewer teeth (as few as a single tooth).

Teeth 62 and 67 may have any suitable form. In some embodiments, teeth 62 and 67:

- are triangular;
- form a "Hirth coupling";
- form a "Hirth coupling" modified to have square teeth or angled teeth;
- have profile angles of 60 degrees;
- comprise different numbers of teeth (one of teeth 62 and 67 may have as few as one tooth);
- comprise materials that are resistant to galling;
- comprise high strength, dissimilar metals;
- comprise ground teeth;
- are angled towards the centerline of the drill string; and/or
- are conical, such that ring 60 is centered/compressed inwardly as teeth 62 and 67 are pressed together.

In some embodiments, teeth 62 and 67 are made of different materials. This may reduce galling. In some embodiments teeth 62 and 67 are machined. In some embodiments teeth 62 and 67 are ground.

In the illustrated embodiment, ring 60 is coupled to male part 34 by a splined connection. The size, shear area, material and number of splines may be selected based on the required torque rating. In an example embodiment, the splined connection has 6 splines and can resist at least 30,000 foot-pounds of torque with a safety factor of three. Ring 60 is shown as having a set of grooves or depressions 64 extending longitudinally and spaced apart circumferentially along its interior surface. Grooves 64 engage a series of corresponding projections 71 that extend longitudinally and are spaced apart circumferentially along the exterior surface of male part 34. Depression 64 and projections 71 are dimensioned to interface to prevent relative rotation of male part 34 and ring 60.

During assembly of coupling 30, male part 34 may be inserted into ring 60 before being inserted into female part 32. Depressions 64 and projections 71 are dimensioned so that ring 60 may slide longitudinally along male part 34 while remaining locked against relative rotational movement. Ring 60 may slide longitudinally between a locked position in which teeth 62 engage teeth 67 of female part 32 (thereby preventing relative rotation of male part 34 and female part 32) and an unlocked position in which teeth 62 are disengaged from teeth 67 (thereby permitting relative rotation of parts 32 and 34).

Coupling 30 includes a mechanism for retaining ring 60 in its locked position. In the illustrated embodiment, a collar 73 is provided to hold ring 60 in place against female part 32. Collar 73 may comprise a shoulder 75 dimensioned to abut ring 60. Collar 73 comprises internal screw threading 77. Male part 34 comprises a complementary screw threading 79. Collar 73 may be rotated relative to male part 34, thereby forcing collar 73 toward female part 32 and compressing ring 60 between female part 32 and shoulder 75 with teeth 62 engaged with teeth 67.

Collar 73 may be tightened using chain tongs, for example of the type commonly used on drill rigs to couple and uncouple sections of a drill string. Collar 73 may be dimensioned such that it can be used with standard sized chain tongs (e.g. tongs with 8-12 inch wide grips).

Screw 77 may be left- or right-hand threaded. In some embodiments, the threading is an Acme Thread or a Stub Acme Thread. In preferred embodiments screw 77 is threaded such that rotation of the drill string in a desired normal drilling direction causes screw threading 77 to tighten. For example, screw 77 may be a left-hand thread in many applications.

The engagement of shoulder 75 and ring 60 provides bearing face friction that further assists in ensuring collar 73 does not unscrew during drilling operations. In some embodiments a locking washer such as a Nord-Lock™ wedge locking washer may be provided between collar 73 and part 32. Where this is done details of the interface between collar 73 and part 32 may be made to accommodate the lockwasher, for example by making the details conform with specifications provided by the lockwasher manufacturer. In some embodiments a jam nut is used to prevent loosening of collar 73.

Sealing members may be provided to prevent drilling fluid and other material from entering the space between collar 73 and parts 32 and 34, including the area around ring 60. Sealing member 81 may be provided between collar 73 and female part 32. Sealing member 82 may be provided between collar 73 and male part 34. As discussed above, sealing member 45 may be provided at the interface between parts 32 and 34. Sealing members 81, 82, and 45 may, for example, comprise suitable O-rings or rotary lip seals. Sealing members may be installed into corresponding glands prior to the assembly of coupling 30.

Figure 4A:
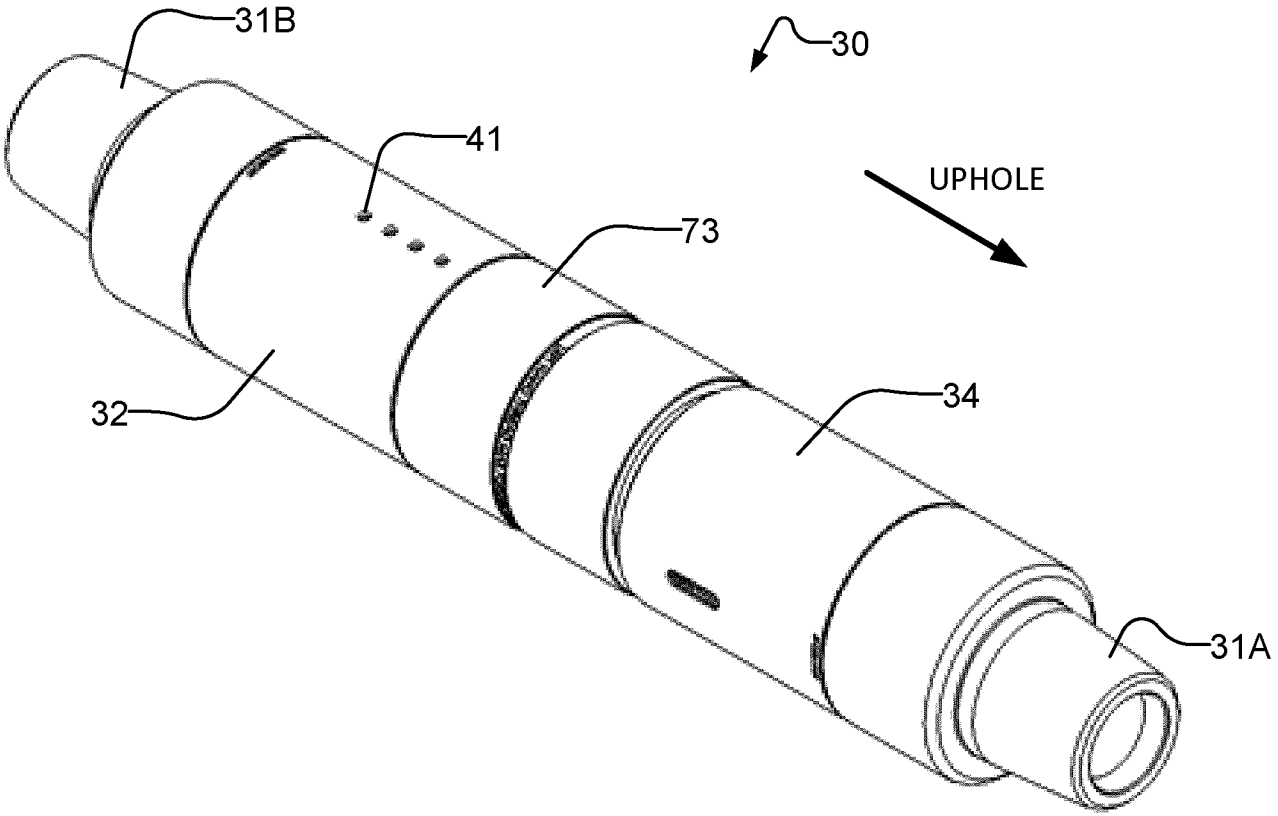
FIGS. 4A, 4B, and 4C are isometric views of the coupling of FIG. 2.
Figure 4B:
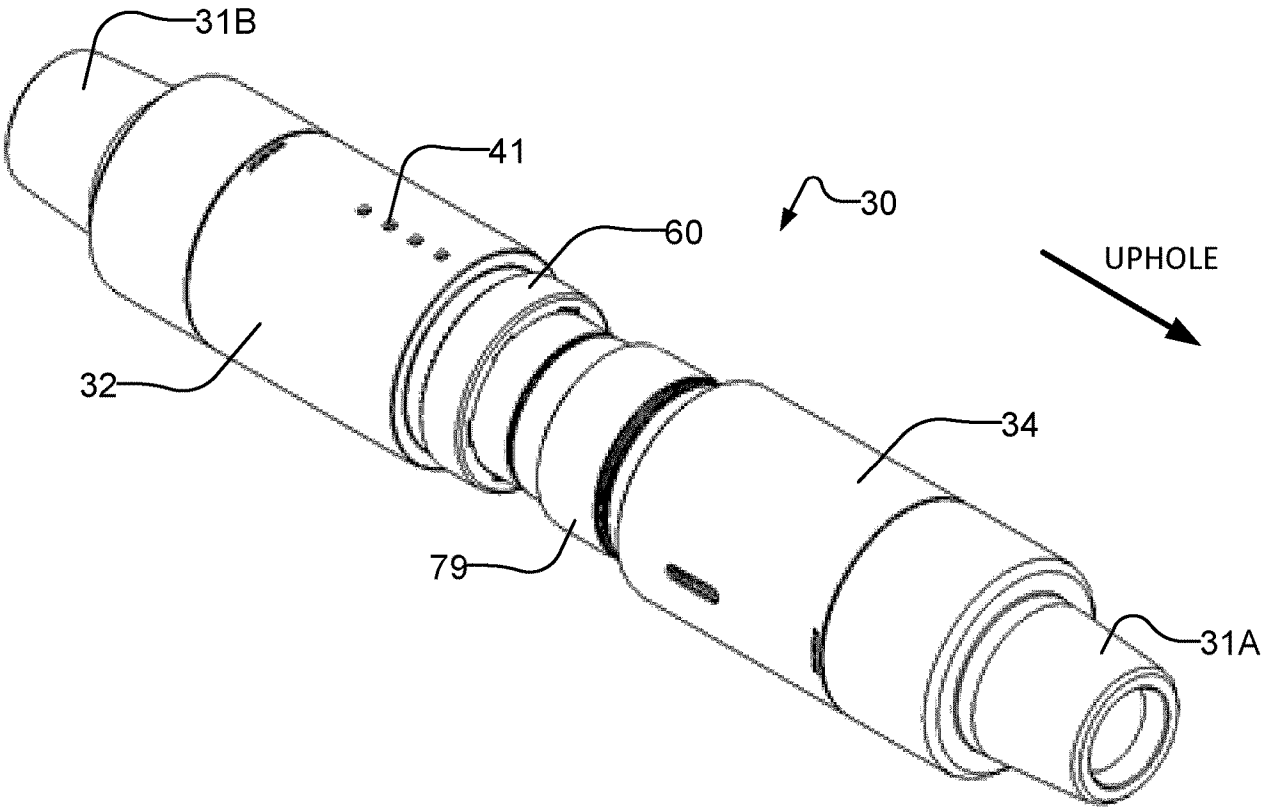
Figure 4C:
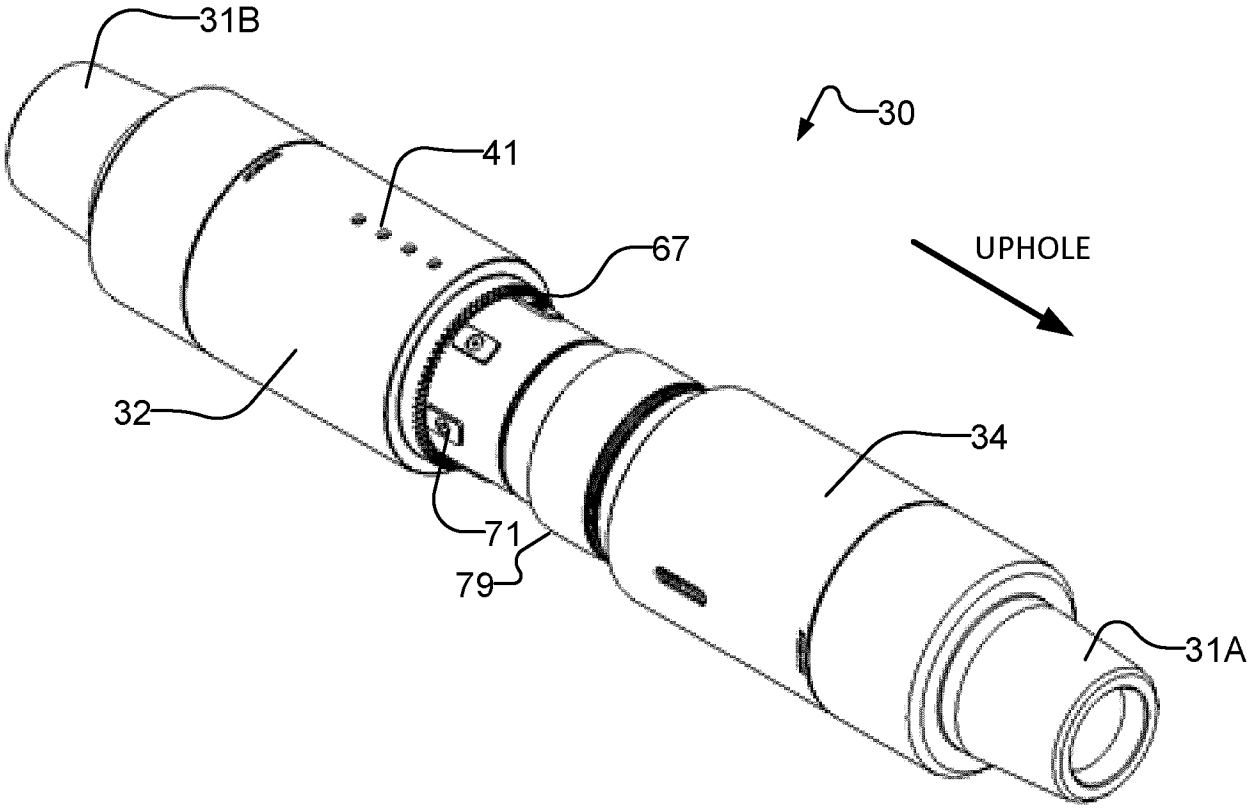

FIG. 4A is an isometric view of coupling 30. FIG. 4B is an isometric view of coupling 30 with collar 73 removed so that ring 60 is visible. FIG. 4C is an isometric view of coupling 30 with collar 73 and ring 60 removed so that teeth 67 and projections 71 are visible.

In alternative embodiments, collar 73 may have screw threading positioned to engage corresponding screw threading on female part 32. In these embodiments collar 73 may be screwed onto female part 32 so that it advances shoulder 75 toward female part 32, thereby compressing ring 60 between shoulder 75 and female part 32. The screw threading on female part 32 may be mounted on an extended portion of female part 32. This extended portion may allow collar 73 to screw onto female part 32 without covering holes 41.

Assembly of coupling 30 may be accomplished by performing the following steps:

(a) place collar 73 over male part 34 (or, in some embodiments, screw collar 73 onto male part 34);
(b) place ring 60 over male part 34 so that depressions 64 of ring 60 engage projections 71 of male part 34;
(c) insert male part 34 into female part 32;
(d) insert balls 37 through holes 41 to fill the channels defined by grooves 36A and 36B;
(e) plug holes 41 to prevent balls 37 from escaping.

After coupling 30 is assembled coupling 30 may be coupled into a drill string and used by:

(f) rotate male part 34 relative to female part 32 to achieve a desired configuration; and
(g) rotate collar 73 thereby causing ring 60 to advance longitudinally toward female part 32 until teeth 62 engage teeth 67 of female part 32 and compressing ring 60 between female part 32 and shoulder 75 to lock rotary coupling 30 at the desired angle.

When coupling 30 is disassembled, collar 73 may be rotated in the opposite direction to release the compression of ring 60 between female part 32 and shoulder 75. Collar 73 may include a retaining ring (not shown) and/or a spring (not shown) that pulls back ring 60 and disengages it from part 32. FIGS. 8C and 8E show the teeth of ring 60 engaged with the teeth of female part 32. FIGS. 8D and 8F show the teeth of ring 60 disengaged from the teeth of female part 32.

Figure 5:
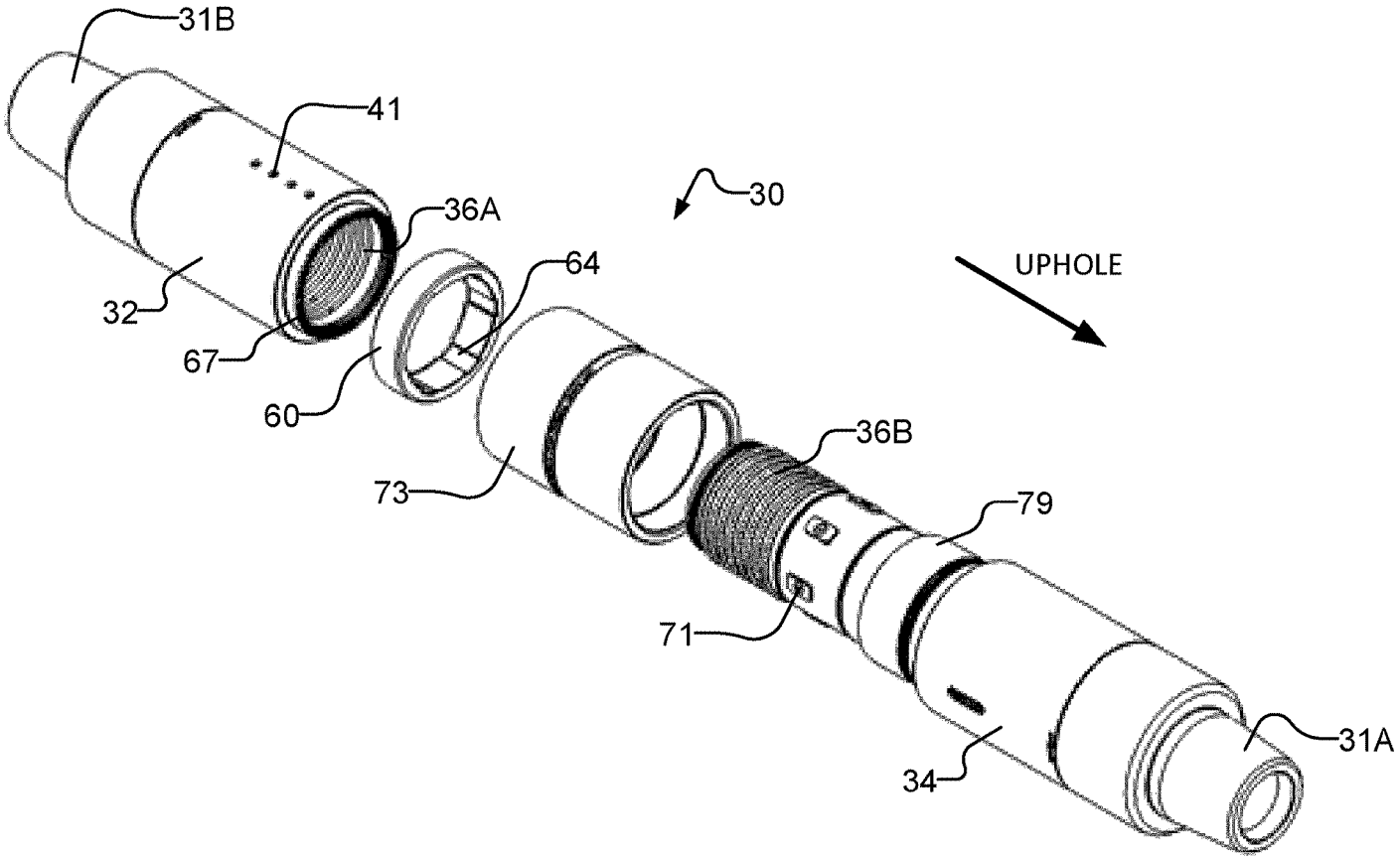
FIG. 5 is an isometric view of the coupling of FIG. 2 in an unassembled state.

FIG. 5 is an isometric exploded view of coupling 30 in an unassembled state. Steps (a) through (c), described above, may be accomplished by starting with the configuration shown in FIG. 5 and then inserting male part 34 through collar 73, ring 60, and female part 32.

Figure 6:
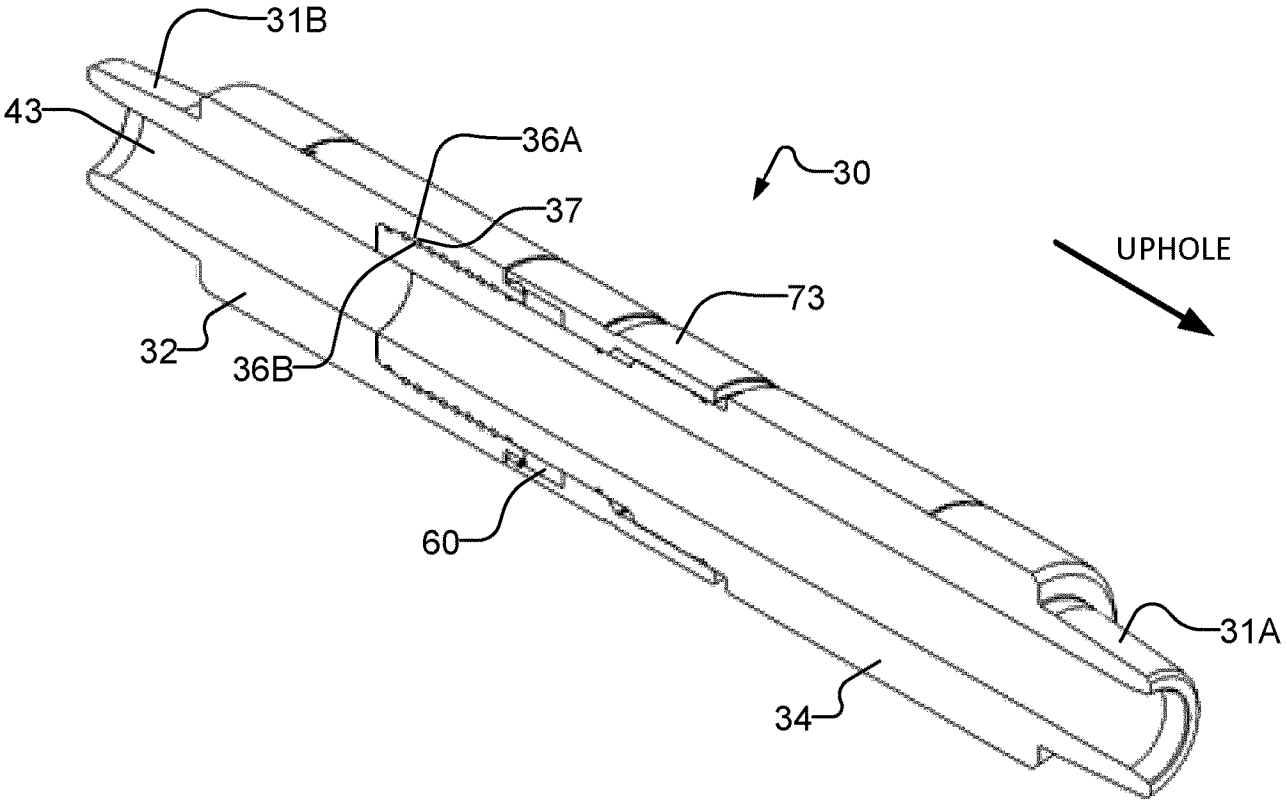
FIG. 6 is a cross-sectional view of the coupling of FIG. 2.

FIG. 6 is a cross sectional view of coupling 30 in an assembled state.

Figure 7:
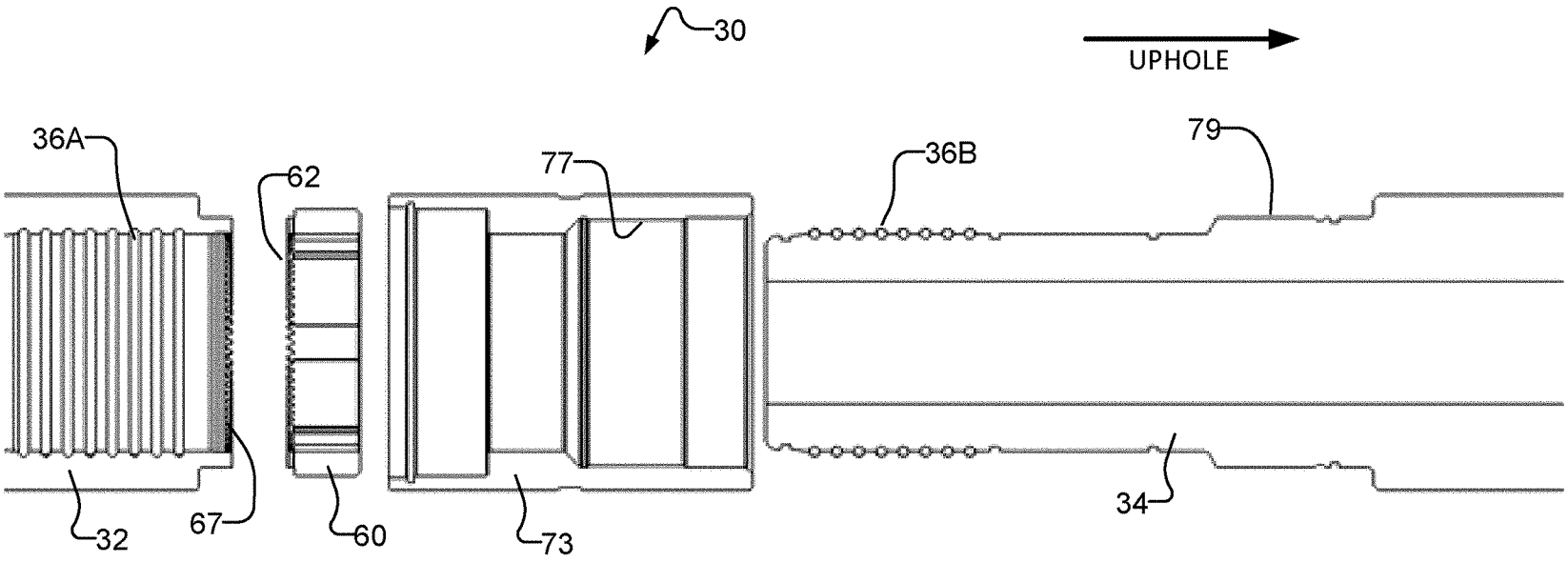
FIG. 7 is a cross-sectional view of the coupling of FIG. 2 in an unassembled state.

FIG. 7 is a cross-sectional view of coupling 30 in an unassembled state.

Figure 8A:
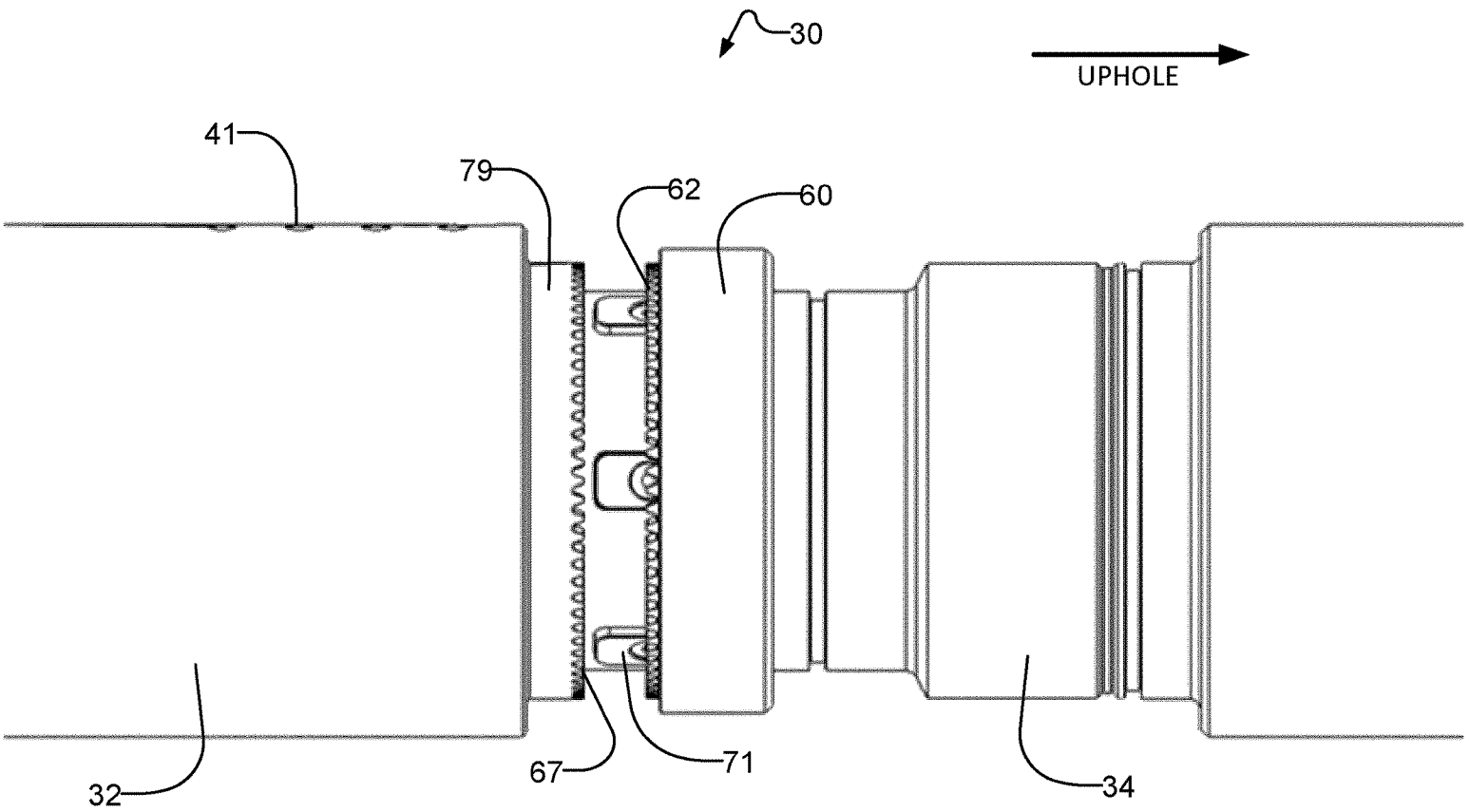
FIGS. 8A and 8B are side elevation views of the coupling of FIG. 2 at progressive stages of assembly. Some portions of the coupling are not illustrated in order to show otherwise hidden structures.
Figure 8B:
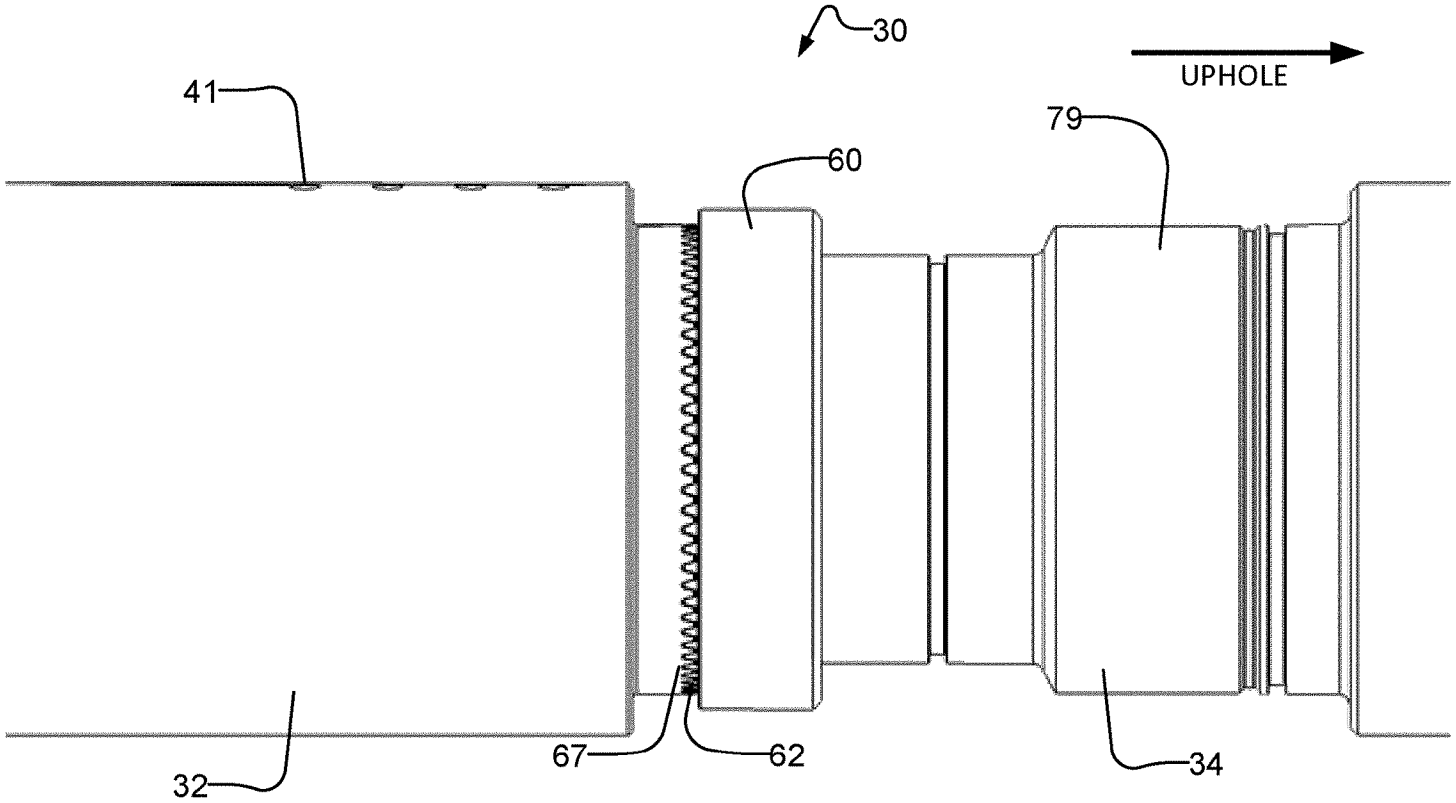
Figures 8C, 8D:
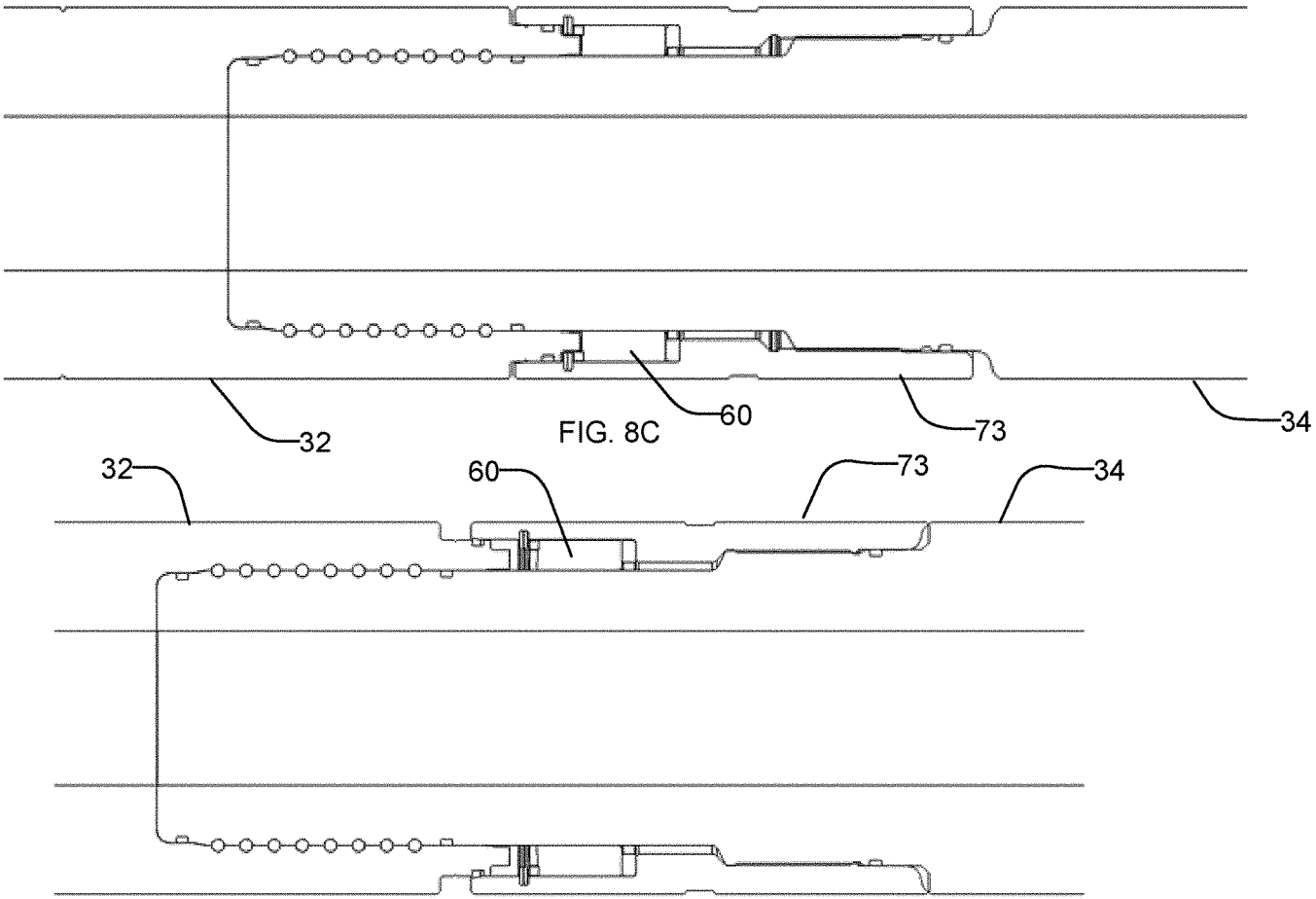
FIGS. 8C and 8D are sectional elevations of a coupling like that of FIG. 2 respectively in a rotationally locked configuration and a rotationally unlocked configuration.
Figure 8E:
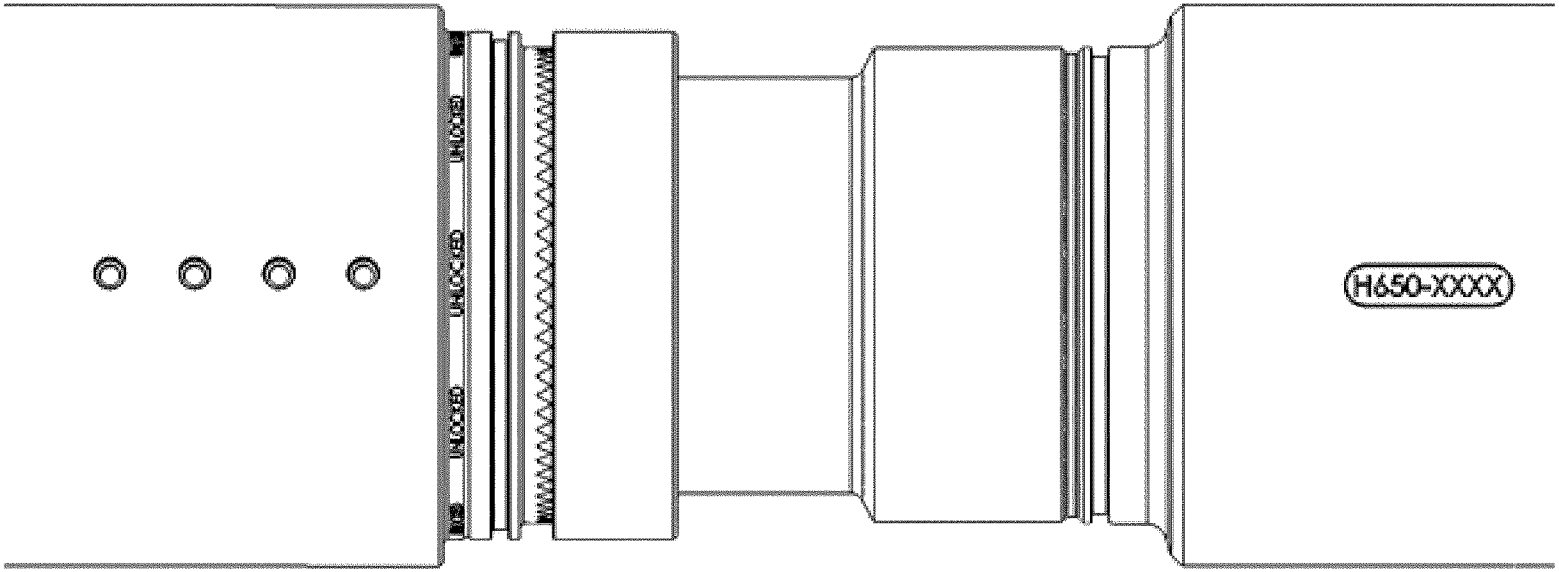
FIGS. 8E and 8F are perspective views of a coupling like that of FIG. 2 respectively in a rotationally locked configuration and a rotationally unlocked configuration (with the locking collar not shown).
Figure 8F:
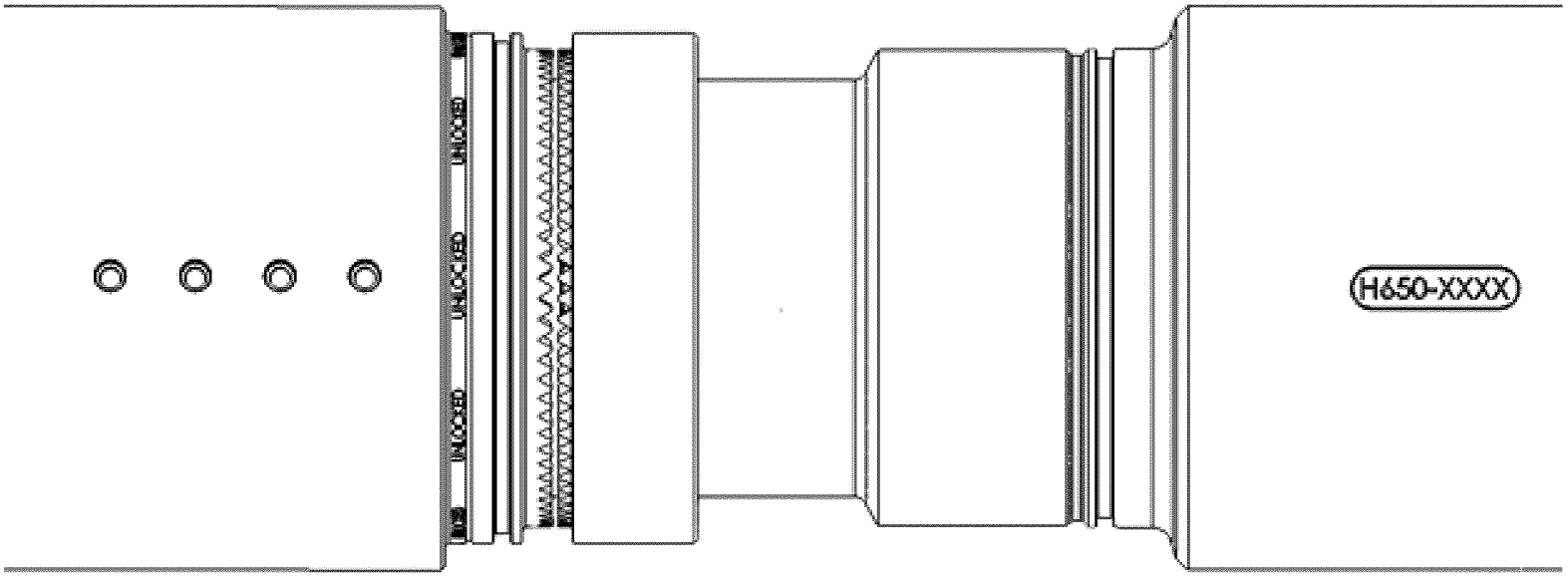

FIGS. 8A and 8B are side elevation views of coupling 30 at progressive stages of assembly. In FIG. 8A, ring 60 engages projections 71, but not teeth 67. In FIG. 8B, ring 60 has been slid longitudinally along projections 71 until it engages teeth 67, thereby accomplishing step (g) described above.

In use, a bent sub may be assembled onto a drill string comprising a rotary coupling 30, for example as described above. The drill string section containing the downhole probe may be marked on the outside with an indicium such as a scribe line, marking, or the like to indicate the reference axis for the sensors that may be aligned with the high side of the bent sub. A downhole probe comprising suitable sensors may be provided uphole from the rotatable coupling.

The "desired configuration" of step (f) may comprise alignment of a marking indicating a high side of the bent sub with a marking indicating a reference axis of a directional sensor. In other embodiments, other types of indicia or markings may be aligned so that the relationship between the orientation of one or more directional sensors and the orientation of a high side of the bent sub is known.

The number of teeth 62 (or teeth 67) may determine the possible number of distinct relative rotational orientations of male part 34 and female part 32. In some embodiments there may be 360 teeth 62, permitting rotation in increments of one degree. In some embodiments there may be greater or fewer numbers of teeth, for example between 40 and 400 teeth. In some embodiments there may be 72 teeth. In some embodiments, the teeth may provide adjustments in increments of 1 degree, 2 degrees, or 5 degrees, for example. In some embodiments the teeth provide rotation in increments of 6 degrees or less.

The engagement of teeth 62 and 67 and the engagement of depressions 64 and projections 71 provide a strong and reliable resistance to relative rotation of male part 34 and female part 32. Furthermore, the maximum torque that can be withstood by coupling 30 is relatively easy to estimate based on the materials and design of the coupling.

It is not necessary in all embodiments that the rotary coupling have a range of rotation of a full 360 degrees. In some applications it will be possible to couple a bent sub to a drill string in such a manner that the high side is within a certain angular range (e.g. 180 degrees or 90 degrees) of a desired angle relative to sensors in a downhole probe. In such embodiments a rotatable coupling adjustable through a portion of a full rotation may be applied.

In some embodiments, a downhole probe is supported in male part 34. The downhole probe may be engaged in bore 43 in such a manner that the probe cannot rotate within bore 43 and also that the reference axis of sensors on the downhole probe are aligned with a reference line of male part 34.

Figure 9:
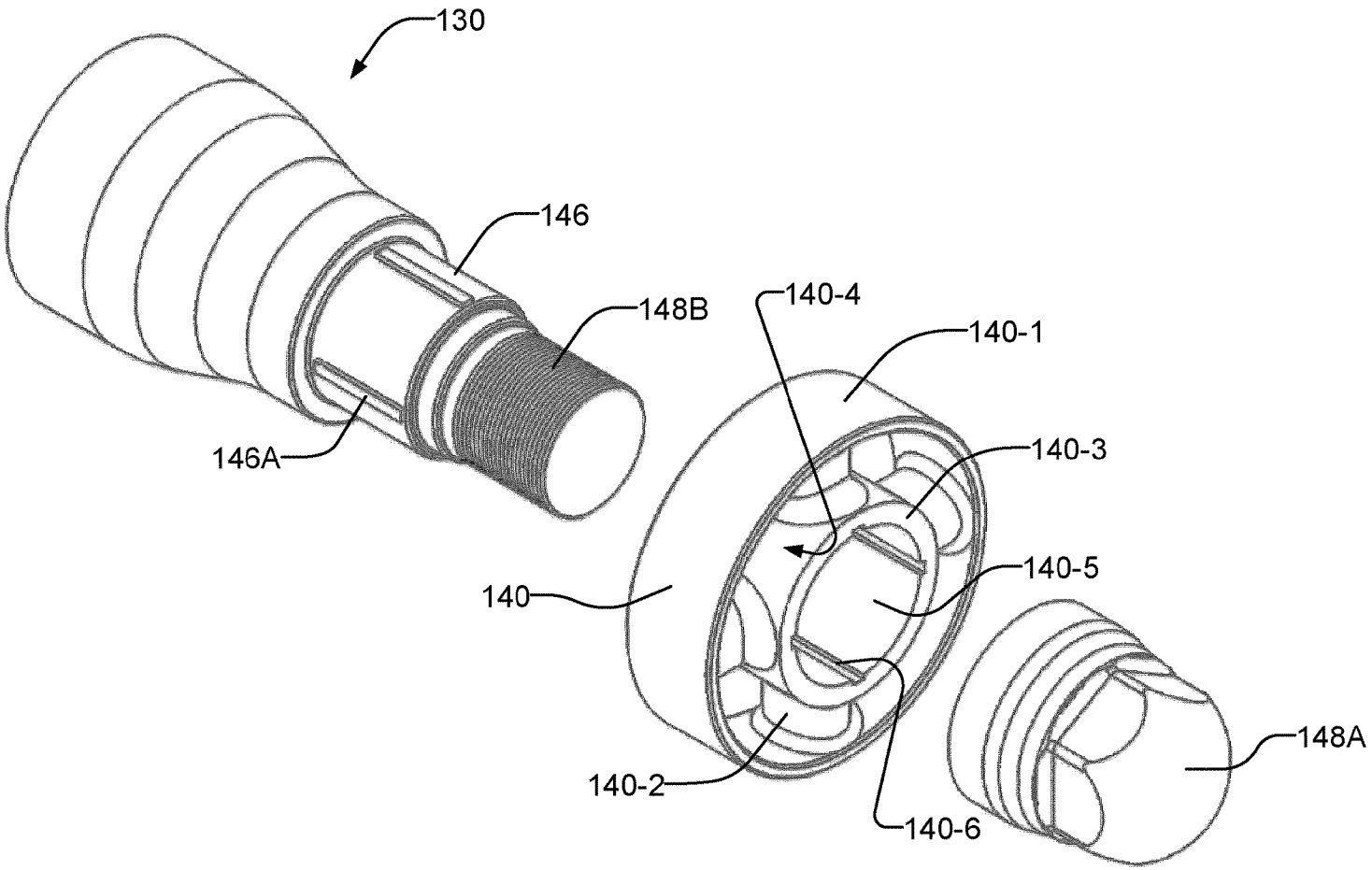
FIG. 9 is an exploded view of the end of a probe showing an example structure for coupling a downhole probe non-rotationally into a section of drill string.

FIG. 9 shows an example construction for non-rotationally supporting a probe in a section of drill string. This construction is one example of a way in which a probe may be supported in male part 34 such that a reference axis for one or more sensors in the probe coincides with a reference line on male part 34. In the illustrated embodiment, a spider is used to couple a downhole probe 130 into a section of drill string. Spider 140 has a rim 140-1 supported by arms 140-2 which extend to a hub 140-3 attached to downhole probe 130. Openings 140-4 between arms 140-2 provide space for the flow of drilling fluid past the spider 140.

To prevent relative rotation of spider 140 and probe 130, spider 140 may be integral with a part of the housing of probe 130 or may be keyed, splined, or have a shaped bore that engages a shaped shaft on probe 130 or may be otherwise non-rotationally mounted to probe 130. In the example embodiment shown in FIG. 9, probe 130 comprises a shaft 146 dimensioned to engage a bore 140-5 in hub 140-3 of spider 140. A nut 148A engages threads 148B to secure spider 140 on shaft 146. In the illustrated embodiment, shaft 146 comprises splines 146A which engage corresponding grooves 140-6 in bore 140-5 to prevent rotation of spider 140 relative to shaft 146. Splines 146A may be asymmetrical such that spider 140 can be received on shaft 146 in only one orientation. An opposing end of probe 130 (not shown in FIG. 7) may be similarly configured to support another spider 140.

Spider 140 may also be non-rotationally mounted to male part 34 or to another section of the drill string above rotatable coupling 30. Coupling of the spider to the drill string section may, for example comprise one or more keys, splines, pins, bolts, shaping of the face or edge of rim 140A that engages corresponding shaping within bore 43 of the drill string section, a press-fit or the like. Where keys are provided, more than one key may be provided to increase the shear area and resist torsional movement of probe 130. In some embodiments one or more keyways, splines or the like for engaging spider 140 are provided on a member that is press-fit, pinned, welded, bolted or otherwise assembled to the drill string section in which the probe is supported. In some embodiments the member comprises a ring bearing such features.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended aspects are interpreted to include all such modifications, permutations, additions, omissions and sub-combinations as may reasonably be inferred. The scope of the aspects should not be limited by the preferred embodiments set forth in the examples, but should be given the broadest interpretation consistent with the description as a whole.

What is claimed is:

1. A drill string section comprising:

a first part;

a second part; and a rotational locking mechanism operable to selectively permit or prevent relative rotation of the first and second parts;

wherein:

the rotational locking mechanism comprises a ring;

the ring is slidably and non-rotatably mounted on the first part;

the ring comprises engagement features configured to engage corresponding engagement features on the second part;

the coupling has a rotatable configuration in which the engagement features of the ring do not engage the engagement features of the second part and the first part is rotatable relative to the second part;

the rotational locking mechanism has a locked configuration in which the engagement features of the ring engage the engagement features of the second part; and the rotational locking mechanism comprises a locking mechanism for holding the coupling in the locked configuration;

wherein the engagement features comprise teeth on a longitudinal end of the ring.

2. A drill string section according to claim 1 wherein the first part comprises an uphole part comprising an uphole coupling for coupling to an uphole section of drill string and the second part comprises a downhole part comprising a downhole coupling for coupling to a downhole section of drill string.

3. A drill string section according to claim 1 wherein the first part comprises a downhole part comprising a downhole coupling for coupling to a downhole section of drill string and the second part comprises an uphole part comprising an uphole coupling for coupling to an uphole section of drill string.

4. A drill string section according to claim 1 wherein the teeth are equally spaced around the circumference of the ring.

5. A drill string section according to claim 1 wherein the rotational locking mechanism is lockable in at least 60 distinct locked configurations, each comprising a distinct angular orientation between the first and second parts.

6. A drill string section according to claim 1 wherein a first bore extends through the first part and a second bore extends through the second part.

7. A drill string section according to claim 6 wherein a male portion of the first part extends into a female portion of the second part, the female portion comprising a length of the second bore.

8. A drill string section according to claim 7 wherein the male portion and the female portion comprise corresponding grooves which define channels dimensioned to receive a plurality of holding members.

9. A drill string section according to claim 8 wherein the female portion comprises openings for inserting the plurality of holding members into the channels.

10. A drill string section according to claim 8 wherein the male portion, female portion, channels, and holding members are dimensioned such that when the male portion is inserted into the female portion and the holding members are inserted into the channels, the first part can rotate relative to the second part but cannot move longitudinally relative to the second part.

11. A drill string section according to claim 8 wherein the holding members comprise balls.

12. A drill string section according to claim 6 comprising a locating feature in the first bore of the first part for holding a downhole probe at a fixed rotation angle in the first bore.

13. A drill string section according to claim 1 comprising an indicium on the outside of the first part indicating a desired highside alignment.

14. A drill string section according to claim 1 comprising a drill collar coupleable to the first part, wherein the outside of the drill collar comprises an indicium indicating a desired highside alignment.

15. A drill string section according to claim 1 comprising a drill collar coupleable to the second part, wherein the outside of the drill collar comprises an indicium indicating a desired highside alignment.

16. A drill string section according to claim 1 comprising a sealing member between the first and second parts.

17. A drill string section according to claim 1 wherein the drill string section is non-magnetic.

18. A drill string section according to claim 1 wherein the coupling has a torque transmission capability of at least 30,000 foot-pounds.

19. A drill string section according to claim 1 wherein the first and second parts are coupled by a rotary coupling arranged to allow relative rotation of the first and second parts but to prevent axial motion of the first part relative to the second part.

20. A drill string section according to claim 19 wherein the rotary coupling comprises a first plurality of circumferential grooves on an outer surface of the first part and a second plurality of circumferential grooves on an inner surface of the second part, the grooves of the first plurality of grooves axially aligned with the grooves of the second plurality of grooves, and a plurality of balls each engaged in one of the first plurality of grooves and one of the second plurality of grooves.

21. A drill string section according to claim 20 wherein the balls comprise ceramic balls.

22. A drill string section comprising:

a first part;

a second part; and a rotational locking mechanism operable to selectively permit or prevent relative rotation of the first and second parts;

wherein:

the rotational locking mechanism comprises a ring;

the ring is slidably and non-rotatably mounted on the first part;

the ring comprises engagement features configured to engage corresponding engagement features on the second part;

the coupling has a rotatable configuration in which the engagement features of the ring do not engage the engagement features of the second part and the first part is rotatable relative to the second part;

the rotational locking mechanism has a locked configuration in which the engagement features of the ring engage the engagement features of the second part; and the rotational locking mechanism comprises a locking mechanism for holding the coupling in the locked configuration;

wherein the rotational locking mechanism comprises a Hirth coupling.

23. A drill string section comprising:

a first part;

a second part; and a rotational locking mechanism operable to selectively permit or prevent relative rotation of the first and second parts;

wherein:

the rotational locking mechanism comprises a ring;

the ring is slidably and non-rotatably mounted on the first part;

the ring comprises engagement features configured to engage corresponding engagement features on the second part;

the coupling has a rotatable configuration in which the engagement features of the ring do not engage the engagement features of the second part and the first part is rotatable relative to the second part;

the rotational locking mechanism has a locked configuration in which the engagement features of the ring engage the engagement features of the second part; and the rotational locking mechanism comprises a locking mechanism for holding the coupling in the locked configuration;

wherein the ring is non-rotatably mounted on the first part by a splined coupling.

24. A drill string section according to claim 23 wherein the splined coupling comprises a depression in the ring dimensioned to receive a projection extending from the first part.

25. A drill string according to claim 24 wherein the splined coupling comprises a plurality of depressions in the ring extending longitudinally and spaced apart circumferentially along an interior surface of the ring.

26. A drill string section comprising:

a first part;

a second part; and a rotational locking mechanism operable to selectively permit or prevent relative rotation of the first and second parts;

wherein:

the rotational locking mechanism comprises a ring;

the ring is slidably and non-rotatably mounted on the first part;

the ring comprises engagement features configured to engage corresponding engagement features on the second part;

the coupling has a rotatable configuration in which the engagement features of the ring do not engage the engagement features of the second part and the first part is rotatable relative to the second part;

the rotational locking mechanism has a locked configuration in which the engagement features of the ring engage the engagement features of the second part; and the rotational locking mechanism comprises a locking mechanism for holding the coupling in the locked configuration;

wherein the locking mechanism comprises a collar with threads that are engageable with threads on the second part to advance the collar longitudinally and thereby compress the ring between the second part and a shoulder of the collar.

27. A drill string section according to claim 26 wherein the threads on the collar are left-hand threads.

28. A drill string section according to claim 26 comprising a first sealing member between the collar and the first part.

29. A drill string section according to claim 26 comprising a second sealing member between the collar and the second part.

30. A drill string section according to claim 29 wherein the threads of the collar are located between the first and second sealing members.

31. A drill string section comprising:

a first part;

a second part; and a rotational locking mechanism operable to selectively permit or prevent relative rotation of the first and second parts;

wherein:

the rotational locking mechanism comprises a ring;

the ring is slidably and non-rotatably mounted on the first part;

the ring comprises engagement features configured to engage corresponding engagement features on the second part;

the coupling has a rotatable configuration in which the engagement features of the ring do not engage the engagement features of the second part and the first part is rotatable relative to the second part;

the rotational locking mechanism has a locked configuration in which the engagement features of the ring engage the engagement features of the second part; and the rotational locking mechanism comprises a locking mechanism for holding the coupling in the locked configuration;

wherein the locking mechanism comprises a collar with threads that are engageable with threads on the first part to advance the collar longitudinally and thereby compress the ring between the second part and a shoulder of the collar.

* * * * *